US005471858A

United States Patent [19]

Deriaz

[11] Patent Number: 5,471,858

[45] Date of Patent: Dec. 5, 1995

[54] APPARATUS AND PROCESS FOR THE PRODUCTION OF A HOLLOW WORKPIECE BEING PROFILED IN A STRAIGHT OR HELICAL MANNER RELATIVE TO THE WORKPIECE AXIS

[75] Inventor: Daniel Deriaz, Mannedorf, Switzerland

[73] Assignee: Ernst Grob AG, Mannedorf, Switzerland

[21] Appl. No.: 25,258

[22] Filed: Mar. 2, 1993

[30] Foreign Application Priority Data

Mar. 4, 1992 [CH] Switzerland ..... 683/92

[51] Int. Cl.[6] ..... B21D 22/16

[52] U.S. Cl. ..... 72/83; 72/96

[58] Field of Search ..... 72/82, 83, 95, 72/96, 98, 100

[56] References Cited

U.S. PATENT DOCUMENTS 4,055,976 11/1977 Kraft ..... 72/83
4,872,250 10/1989 De Marco .

FOREIGN PATENT DOCUMENTS 2301318 9/1976 France .
2549230 9/1976 Germany .
3931599 2/1991 Germany ..... 72/82
579427 9/1976 Switzerland .

*Primary Examiner*—Lowell A. Larson
*Attorney, Agent, or Firm*—Sandler, Greenblum, & Bernstein

[57] ABSTRACT

The well-known Grob cold forming machine for carrying out the Grob method of impact roll-shaping utilizes rolling head carriers that move toward and away from the workpiece wherein each rolling head carrier is provided with rotatably driven rolling heads. Journalled in the rolling heads are impact formers or rollers which, during rotation of the rolling head, within their circle of rotation perform single forming steps on the workpiece which is mounted on a mandrel. In addition, each rolling head carrier carries a freely rotatably journalled pressure roll having an axis parallel to or angled relative to the mandrel axis, the pressure roll being located outside the rotational circle of the impact former. Via the use of pressure rolls, mainly axial shaping is achieved and thereafter, via the use of the impact former, mainly radial shaping is achieved in the same set-up and on the same mandrel.

4 Claims, 8 Drawing Sheets

APPARATUS AND PROCESS FOR THE PRODUCTION OF A HOLLOW WORKPIECE BEING PROFILED IN A STRAIGHT OR HELICAL MANNER RELATIVE TO THE WORKPIECE AXIS

CROSS REFERENCE TO RELATED APPLICATION

This application claims the priority of Swiss Application No. 00 683/92-9, filed Mar. 4, 1992, the disclosure of which is incorporated herein by reference in its entirety.

BACKGROUND OF THE INVENTION

1. Field of the Invention

This invention pertains to a new and improved apparatus and process for the production of a hollow workpiece being profiled, preferably at least internally, in a straight or helical manner relative to the workpiece axis via cold forming.

According to the invention, workpieces are produced that have profiling on their inside and/or the outside surfaces.

When profiling is produced on both the inside and outside surfaces more or less close similarity or far reaching differences between the inner and outer profile can be produced.

In terms of the profiles per se, the gearing or toothing being produced, for example, can be fabricated either as a splin or a gear.

2. Background of the Invention

For the production of quality precision profiles, for example, gearing or toothing, relative to hollow workpieces the well know Grob method is outstanding. This method will be summarized hereinafter even though in this particular technology or art, both from documentation as well as from actual practice, it is of world renown and no further explanation is needed for those skilled in this art.

For example, the special development of the Grob method which permits the fabrication of an outer toothing or gearing in a relatively thick-walled hollow workpiece is disclosed in Swiss Patent No. 579,427, in French Patent No. 7,538,539 and in German Patent No. 25 49 230, to which reference may be readily had and the disclosures of which are incorporated herein by reference. With these methods, different toothings or gear tooth systems can be fabricated on the inside and the outside of the workpiece.

In a relatively thin-walled hollow workpiece, the Grob method of impact roll-shaping permits fabrication via cold forming or cold working to simultaneously produce an outer profile and an inner profile, whose profiles may differ. For this, the tubular portion of the raw or unfinished workpiece is mounted on a specific mandrel or holder whose external toothing or teeth correspond to the internal toothing or teeth of the workpiece which is to be fabricated. The workpiece in this setup is infed or advanced along its workpiece axis and turned or rotated relative thereto. During this workpiece feed, the workpiece is externally worked by annular or ring-like profiled forming rolls or rolling tools, whereby each forming roll or rolling tool performs single or individual blow-like or impact-forming operations in rapid succession in coupled sequence in the direction of the advance of the workpiece. The single or individual blow-like impact or forming operations are consecutively carried out by the same forming roll or rolling tool in a screw-like or helical zone determined by the infeed of the workpiece. The consecutively following single forming processes, in the direction of the profile, within the same tooth spacing, are accomplished as operations on the workpiece in a partially overlapping manner. In the process of cold forming on the profiled mandrel during each single blow-like or impact-forming operation, material is pushed along a relatively small section of the workpiece into the depressions of the mandrel, namely flowing mainly in a radial direction.

With relatively thick-walled workpieces, inner profiles can only be produced via the use of a profiled mandrel. If the form or shape of the outer surface is not of great consequence, it can be finished more or less smooth or even. Rolling heads or forming tools without any profiling may be utilized since they do not have to be exactly synchronized with reference to the rotation of the workpiece.

In the prior state of technical development the substantially dished or pot-shaped hollow bodies have been produced on very expensive step or transfer presses in multiple steps. It is only after the last pressing step that the unfinished or hollow bodies can be transferred to Grob machines and mounted on mandrels or holders thereon and be subsequently finished or further worked upon via the Grob method.

SUMMARY OF THE INVENTION

A primary purpose or objective of this invention is to produce hollow profile workpieces, via the Grob method, even more economically and even more advantageously with at least the same or increased levels of product quality.

In order to achieve this purpose, the apparatus and method of the invention are utilized for the production of a profiled hollow body, by means of cold forming, in accordance with the Grob method, without the aforementioned drawbacks and shortcomings of the prior art techniques.

Another and more specific object of the present invention is the provision of a new and improved apparatus and method which improve upon the Grob method by utilizing the use of but a single workpiece set-up with but one mandrel to permit both the forming of a workpiece disk into an intermediate stage workpiece, having a webbed portion joined to a substantially tubular rim portion and thereafter cold working, as per the well-known Grob method, the rim portion so as to produce a hollow final workpiece having straight or helical profiles either on one or both of the rim interior and exterior surfaces.

Specifically, this invention sets forth an apparatus for the production of a hollow workpiece, starting with a workpiece disk having an at least internal straight or helical profile, relative to the workpiece axis, having a mandrel with a straight or helical profile coaxial with the mandrel axis, and means for retaining the workpiece disk and the mandrel. Means for driving the workpiece retaining means both along the axis of the mandrel and rotatably about the mandrel axis are utilized together with at least one rolling head carrier which is adjustably mounted relative to the axis of the mandrel. A rotatably driven rolling head is mounted on the carrier as is a freely rotatable pressure roll which is journalled thereon, the pressure roll having an axis parallel with or angled relative to the mandrel axis. The pressure roll is adapted, in conjunction with the workpiece retaining means, the driving means, and the mandrel to form the workpiece blank into a hollow intermediate stage workpiece having a webbed portion joined with a substantially tubular rim portion. At least one impact former or roller, having an outer profile, is rotatably journalled in the rolling head for planetary type rotation therewith and defines an outermost circular periphery, with the pressure rolls being located outside of this periphery. It is the impact former together with the profile mandrel which constitute means for carrying out a partial forming step on at least an internal surface of the intermediate stage workpiece rim portion, during every rotation of the rolling head, thereby producing the profile on the hollow workpiece.

Preferably, at any one time, two oppositely located rolling head carriers are used, each of which is provided with one rolling head and one pressure roll.

The profiles of the impact former and the mandrel may differ or they can be substantially similar. Preferably, the impact former and the mandrel profiles take the form of toothings.

If desired, the impact former and the mandrel can be so profiled that carrying out a partial forming step at least on one or both of the internal and external surfaces of the rim portion of the intermediate stage workpiece during every rotation of the rolling head produces such profiles on the workpiece.

Specifically, at least one of the mandrel and impact former has a straight or helical outer profile, thus producing workpieces having either an internal or external profile surface taking the form of straight or helical toothings. If both the mandrel and impact former are profiled, then both the interior and exterior workpiece surfaces will be profiled.

Turning now to the method of the invention, the method produces a hollow workpiece having at least a partial web portion and a substantially tubular rim portion connected thereto, wherein the rim portion has a straight or helical profile relative to the workpiece axis, wherein the method includes the steps of providing a workpiece blank or disk and providing a set-up including a workpiece retaining means and a mandrel, whose profile corresponds to the internal profile which is to be produced on at least a portion of the workpiece blank. The process proceeds via forming of the workpiece blank on the mandrel into a hollow intermediate stage workpiece having the noted web and rim portions. This is followed by cold working the intermediate stage workpiece rim portion on the mandrel according to the Grob method of impact roll-shaping to form the hollow workpiece with a profile on one or both of the rim interior and exterior surfaces, both the forming and cold working being performed using the same set-up and the same mandrel.

In the method of the invention, the profile of the mandrel is an external profile which corresponds to the internal profile which is to be produced on the internal surface of the workpiece rim portion.

The method may also include the step of producing substantially simultaneously, with the production of the internal profile on the workpiece rim portion, an external profile, such profile preferably taking the form of toothings.

In one embodiment of the invention, the internal profile on the workpiece rim portion is smooth while the external profile on the workpiece rim portion takes the form of toothings.

Specifically, the noted forming steps entail using a pressure roll in conjunction with workpiece retaining means and the mandrel.

Even more specifically, the noted forming step includes the axial pressing of the workpiece, via the pressure roll, against the outer surface of the mandrel for producing a substantially tubular rim portion, preferably utilizing two diametrically opposed pressure rolls.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally used the same reference characters to denote the same or analogous components and wherein.

DETAILED DESCRIPTION OF THE PREFERRED EMBODIMENTS

Figure 1:
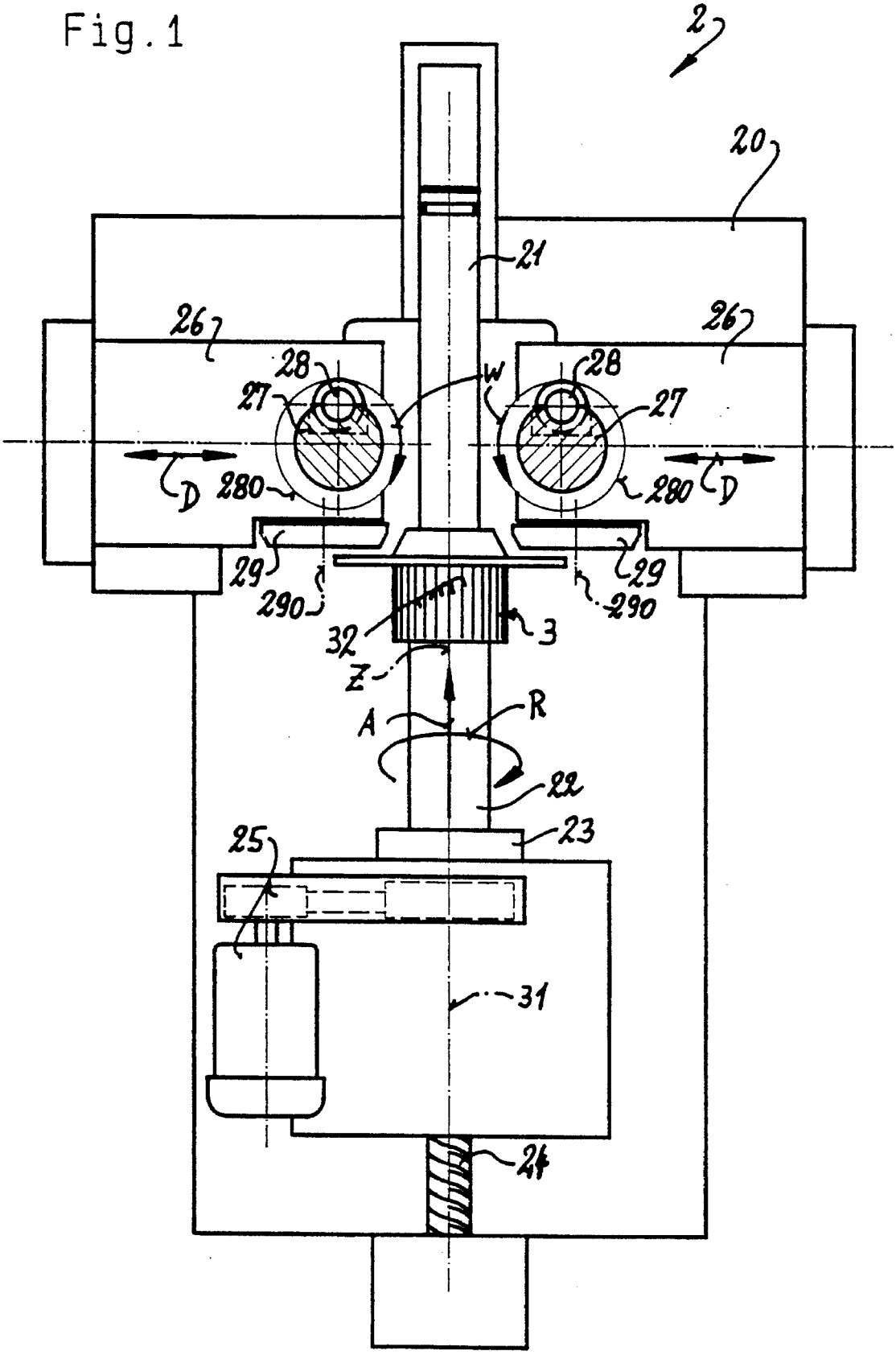
FIG. 1 is a top plan view of an apparatus for carrying out the Grob method.

Before beginning an extensive discussion of the drawings there will now be first listed the various elements and reference characters depicted therein and their significance as follows:

A axial thrust or advance direction of mandrel 3
B in an outfeed direction of forming tool carrier 26
R rotational movement direction of mandrel 3
W direction of rotation of rolling head/forming tool 27
Z workpiece axis
1 workpiece with internal gearing or toothing construction (FIG. 8)
10 workpiece with internal and external gearing or toothing construction (FIG. 9)
11 blank or unfinished or raw material disk
111 formed hollow body (already pressed)
112 web portion of body 111
113 tubular rim portion of body 111
2 device or apparatus
20 machine frame
21 retaining punch or die
22 reciprocal, opposing or counter punch
23 drive carriage or slide
24 screw spindle or lead screw
25 drive mechanism for lead screw 24
26 rolling head or forming tool carrier
27 rolling head or forming tool
28 impact or cold former or roller for workpiece 1
280 rotational circular periphery of impact roller 28
281 impact or cold former or roller for workpiece 10
29 pressure roll
290 roller axis
3 mandrel for workpiece 1
30 mandrel for workpiece 10 (FIG. 9)
31 mandrel axis (coaxial with workpiece axis Z)
32 toothed profile or gearing of mandrel 3.

Turning now to the drawings, wherein the invention is illustrated in sufficient detail to permit one to readily understand the present invention, apparatus 2, as shown in FIG. 1, utilizes a retaining punch or die 21 mounted in machine frame 20 coaxial with mandrel axis 31, which also corresponds with workpiece axis Z. The movement of counterpunch 22, also located on axis 31, moves or controls punch 31.

Between the two punches or dies 21, 22 a blank disk 11 and a mandrel 3 are shown in a clamped condition.

The counter punch 22 can be rotated by drive carriage or slide 23 in the direction of arrow R so that the direction of rotation of mandrel 3 and blank disk 11 or formed hollow body 111 is transferred to workpiece 1.

In addition, drive carriage 23 can, in cooperation with the rotation of rolling heads 27 in their direction of rotation, be advanced via lead screw 24 in an axial direction as shown by arrow A. The drive mechanism 25 for lead screw 24 can, for example, be provided with an electronic control device, not shown.

In machine frame 20 there are two opposed rolling head carriers 26 which can, via adjustment plungers (not shown) be moved in the direction of double headed arrows D relative to mandrel axis 31, that is axis Z, toward or away therefrom. In normal operation in the illustrated embodiment a correct distance is set and left unchanged until the forming or rolling is finished, or the distance is changed during the process of rolling utilizing a numerical control spindle in accordance with the desired technological requirements. For reversing and for the ejection of the finished workpiece the necessary adjustments may of course be made.

In each of rolling head carriers 26 a rolling head 27 is drivingly journalled. The drive can be by any desired known means. The rolling heads 27 are driven in opposite directions in a synchronous manner so that the impact formers or rollers 28 mounted thereon simultaneously act on either internally toothed workpiece 1 or formed hollow body 111. In addition synchronization can be achieved for rotational movement of the workpiece 1 or hollow body 111 via non-illustrated but well known mechanical or electronic means.

Each of rolling heads 27 is shown here as having but a single impact roller 28. Additional rolling heads could also be utilized which will necessitate changing of the drive means accordingly. Each rolling head carrier 26 is provided with a pressure roll 29 which is freely rotatable on roller axis 290.

As is illustrated, the pressure rolls 29 can be dimensioned in such a manner that the delivery or infeed, at the end of the pressure operation need not be changed in order to initiate the impact rolling or forming.

The process can also proceed in such a manner that the infeed or reverse feed of the rolling head carrier proceeds in the direction of double headed arrows D during the pressing operation or thereafter change the infeed. This can also be accomplished via a numerical controlled spindle.

Figure 2:
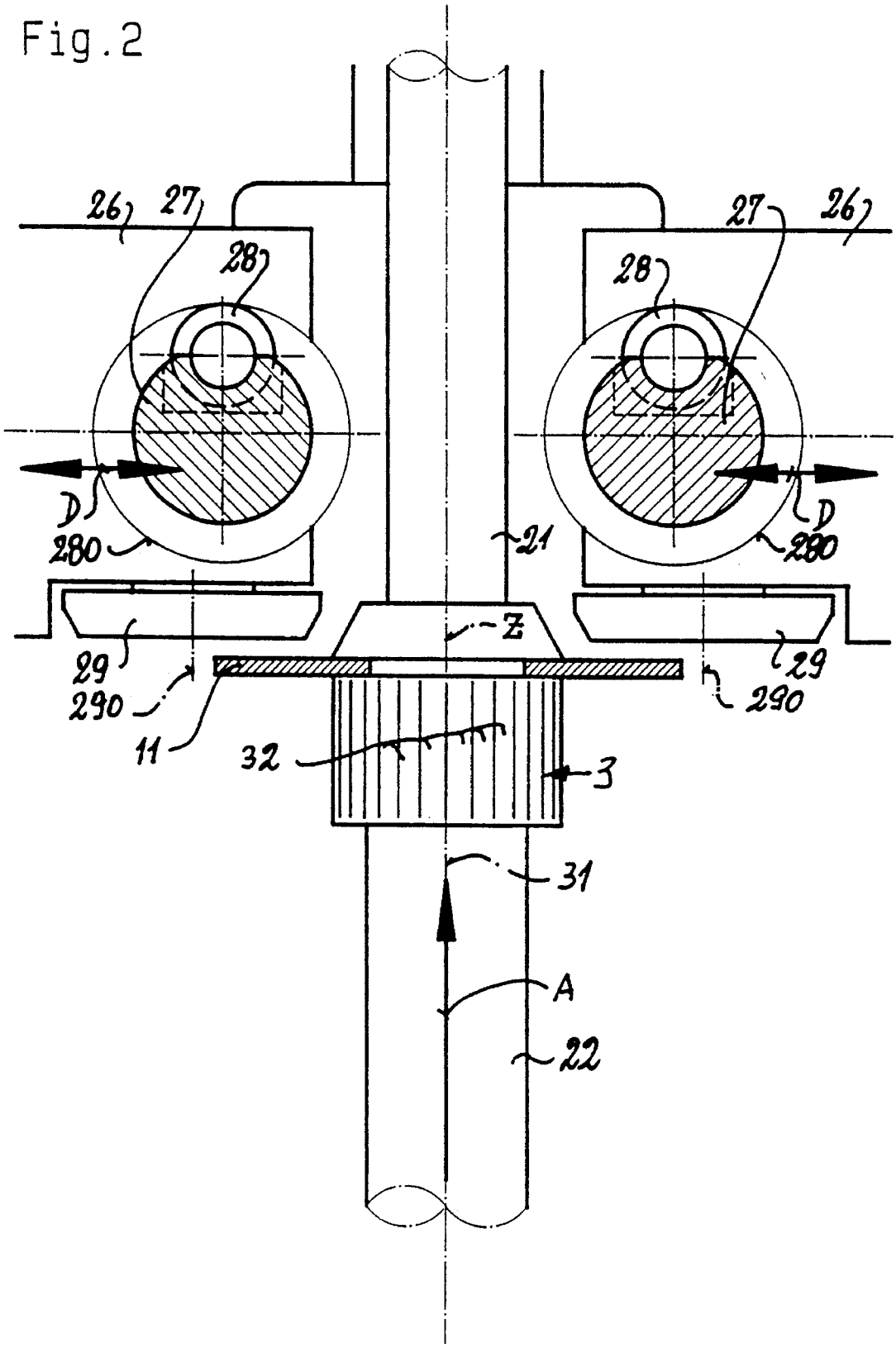
FIG. 2 is, with respect to FIG. 1, an enlarged top plan view portion of the general workpiece area prior to the start of the cold forming operation wherein the workpiece is shown in section.

In the inventive process for the production of the profiled workpieces, here specifically internally toothed or geared workpiece 1, proceeds in the following manner:

The unfinished disk or blank is mounted in the manner shown in FIGS. 1 and 2. Thereafter, the rolling head carrier 26 is set in the position shown in FIGS. 1 and 2 so that the pressure rolls 29, during the advance of blank disk 11, in the direction of arrow A, formingly engage blank disk 11.

Figure 3:
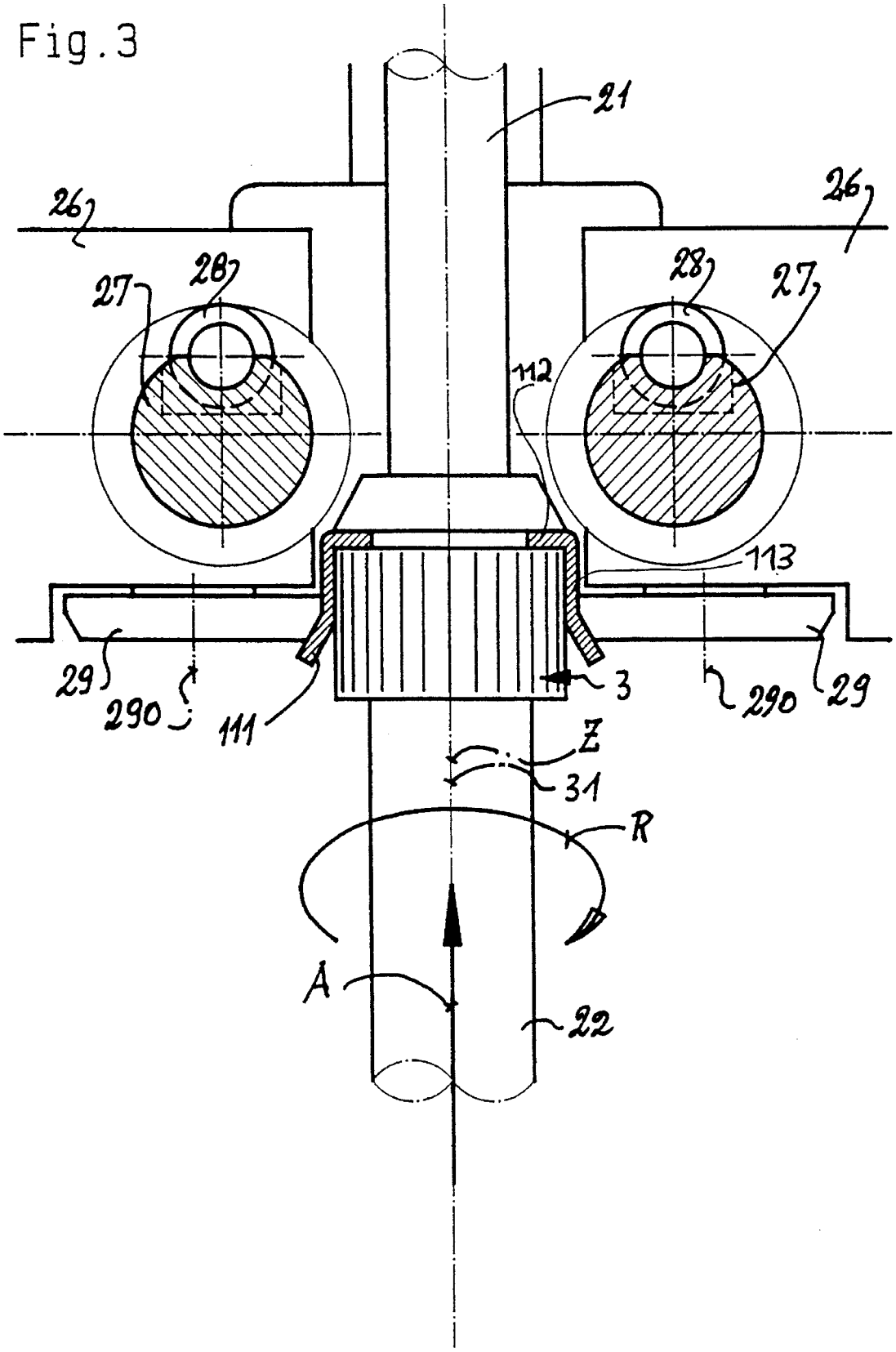
FIG. 3 is the portion of FIG. 2 during the pressing process.
Figure 4:
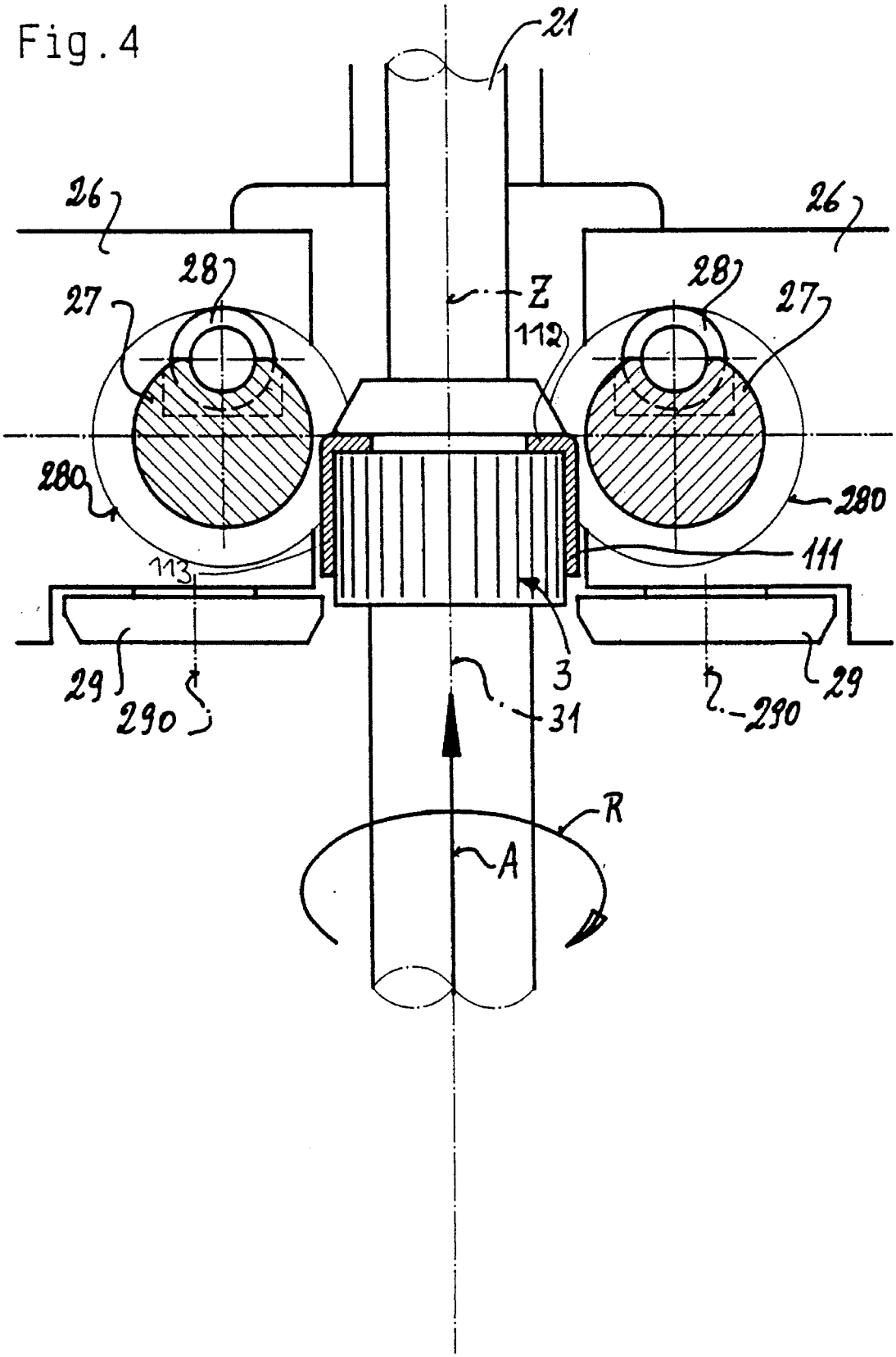
FIG. 4 is the portion of the FIG. 2 after the pressing operation and immediately prior to the impact or cold forming operation.
Figure 5:
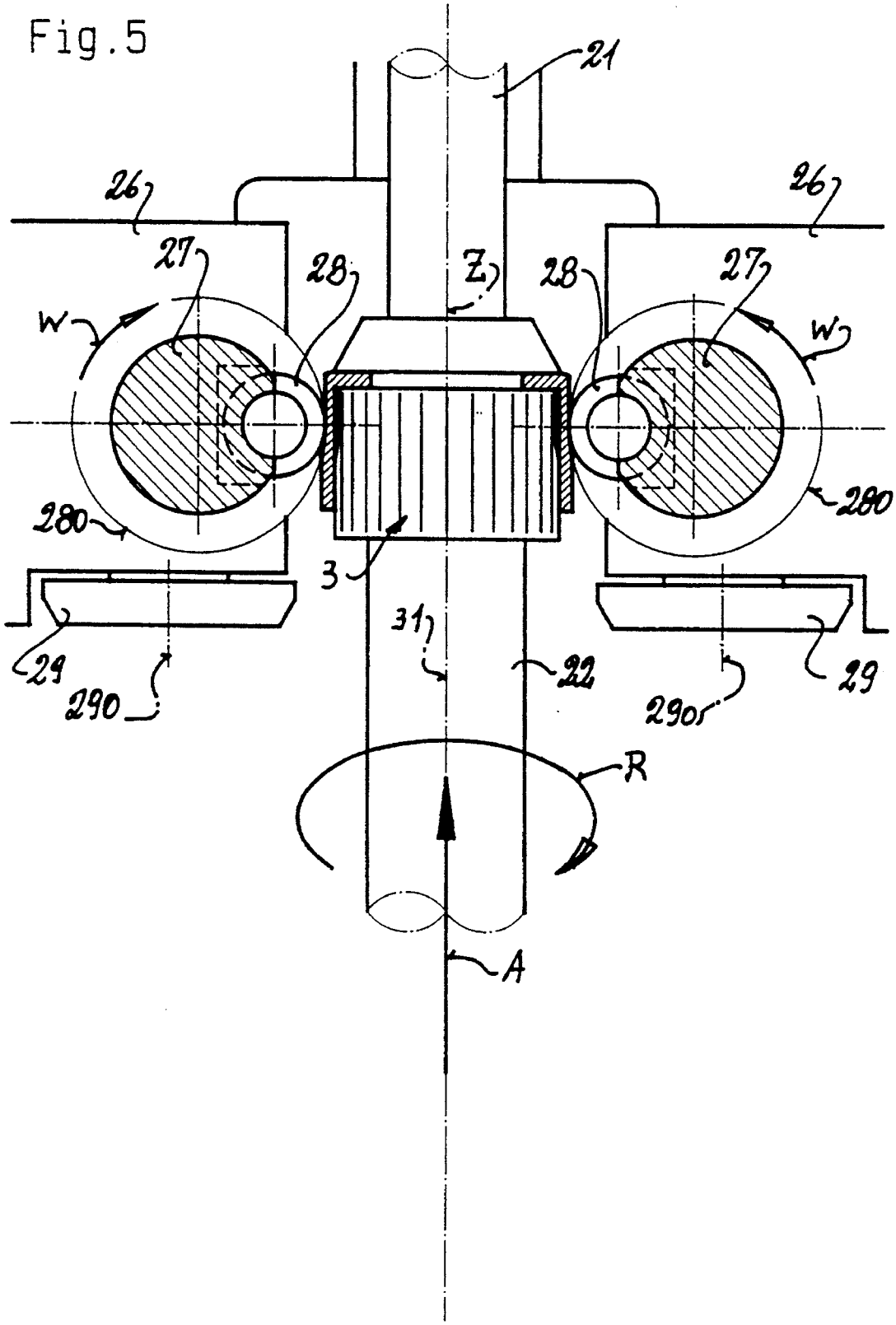
FIG. 5 is a portion of FIG. 2 during the process of cold forming or impact forming.
Figure 6:
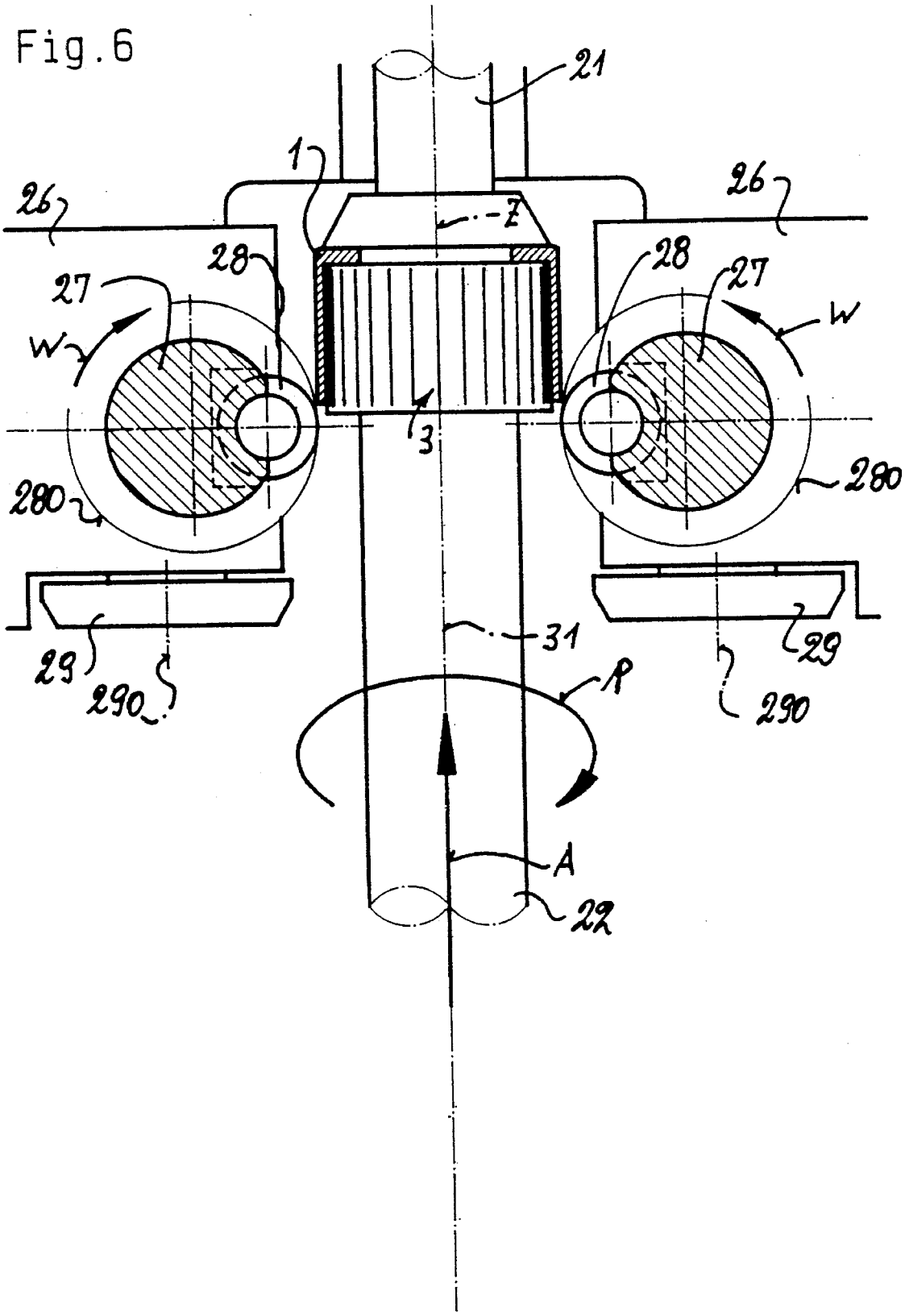
FIG. 6 is a portion of FIG. 2 upon completion of the cold or impact forming.
Figure 7:
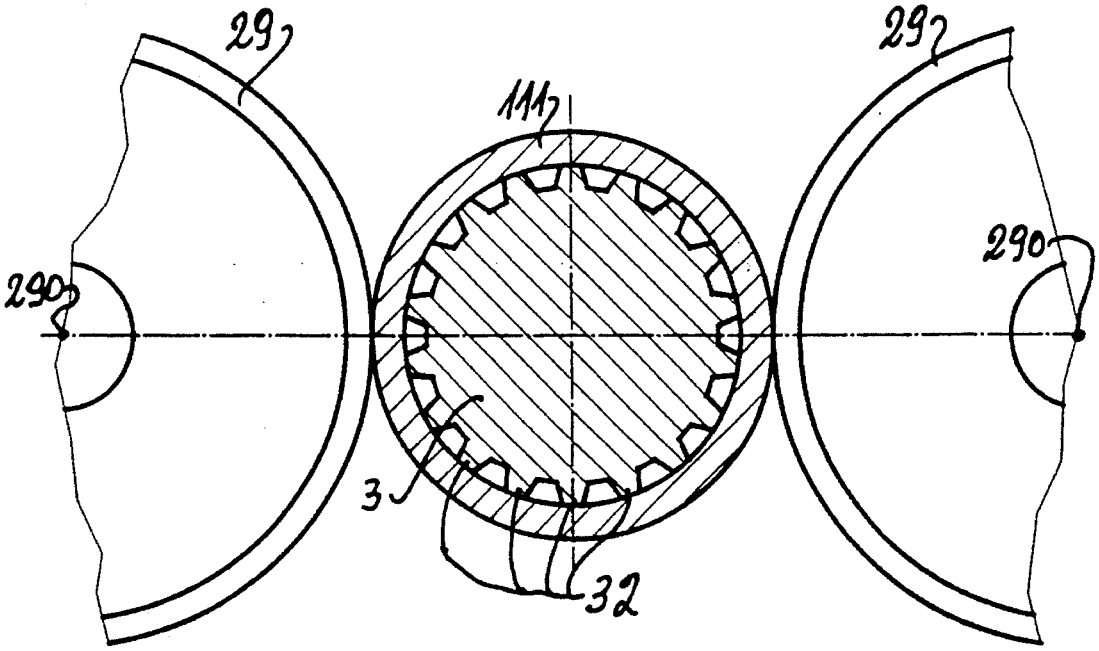
FIG. 7 is a cross-section of FIG. 4 through the pressed workpiece.

FIG. 3 shows approximately the central position or mid position during the pressing operation. During the pressing operation the material is mainly formed or reshaped in the direction of mandrel axis 31. At the conclusion of the pressing operation the position shown in FIG. 4 is achieved and the formed hollow body 111 achieves its finished form on mandrel 3. Thus, blank or workpiece disk 11 is formed into a hollow body, taking the shape of a can or container, having a partial web portion 112 connected with a substantially tubular rim portion 113. During the entire pressing process impact rollers 28 are in the position shown in FIGS. 1–4 so that they do not hinder the pressing process during its operation. The positioning can also be achieved via a numerical control spindle drive system for rolling heads 27.

Now the impact or cold forming steps, according to the Grob method of impact roll-shaping, as already previously described in the "Background of the Invention", can be initiated. It is important that the pressure rolls are outside the rotational circle 280 of impact formers or rollers 28. Otherwise, the process can continue in the known manner according to the Grob method wherein the workpiece material is mainly formed or shaped radially relative to mandrel axis 31.

Figure 8:
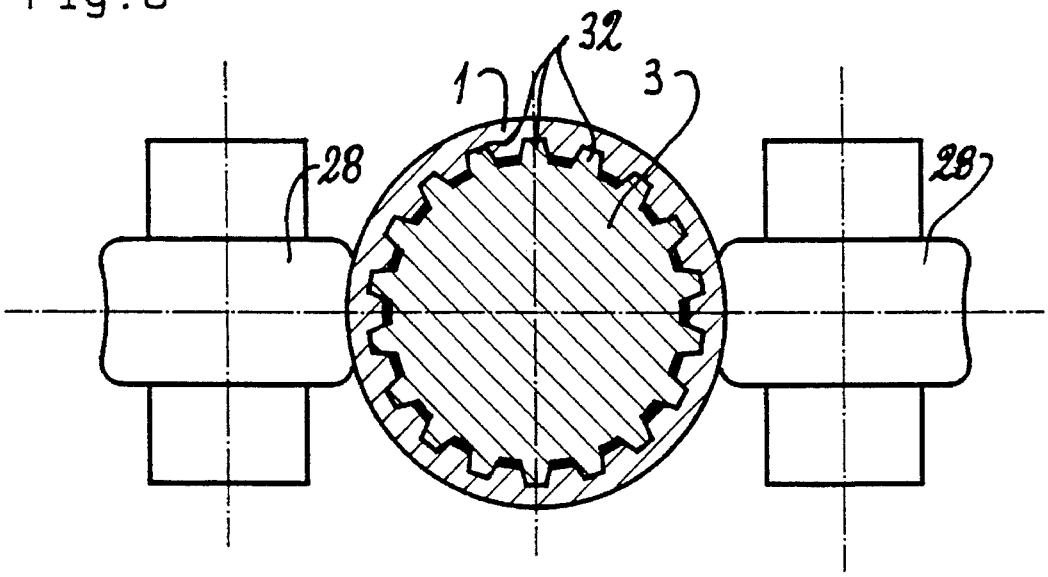
FIG. 8 is a cross-section through a workpiece that is only internally profiled.

Through the impact forming process there is produced in a typical manner, via the Grob method, a gradual or progressive inner tooth forming on workpiece 1. This step-wise forming by means of profile 32 of mandrel 3, is best shown in FIG. 8.

In this manner the process, for example, proceeds as follows:

From a blank disk 11, with a metal wall thickness of 4.5 millimeters, a hollow blank body is formed during the first working step to produce a can or container, with a wall thickness of also 4.5 millimeters having an inner diameter of 170 millimeters. This can be accomplished, for example, with workpiece number of rotations (with the mandrel) being at 20 revolutions per minute, with the axial advance of the workpiece, with the mandrel being at 50 millimeters per minute.

Thereafter, in the same set-up on the same hollow body and the same mandrel, the hollow body 111 is provided with an internal toothing according to the Grob method as per the following example:

The number of teeth on the internal gearing or toothing Z is 40; the number of revolutions of the rolling head is 1400 revolutions per minute; the number of rotations of the workpiece (with the mandrel) is 35 rotations per minute; and the workpiece advance (with the mandrel) being 300 millimeters per minute.

When the outer or external surface of the workpiece 1 is again worked upon by the pressure rolls, the outer surface can be improved if necessary so that one may for example, omit a further finishing operation.

Figure 9:
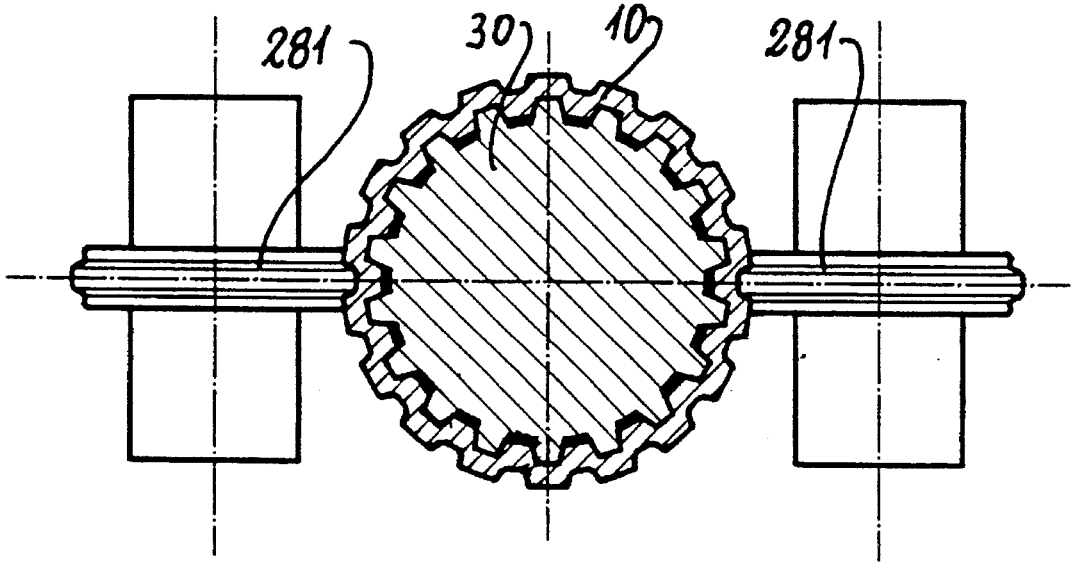
FIG. 9 is a cross-section through a workpiece that is profiled both on its interior and exterior surfaces.

When mandrel 3 is replaced with mandrel 30, as in FIG. 9, and impact formers 28 are replaced with impact formers or rollers 281, in FIG. 9, and when the movement of the workpiece revolutions are synchronized with the number of revolutions of the rolling head there is obtained, without any other changes, in apparatus or working steps, a profiled workpiece 10 (FIG.9) that is provided with inner and outer toothed profiles in the known manner of the Grob method.

If desired, only an outer profile or toothed surface may be produced, for example, when the Grob method is used in its known manner although not illustrated here, if a smooth mandrel is utilized with a profiled impact roller.

In addition, differing or diverging inner and outer profiles can be obtained when utilizing the Grob method in a known manner although not shown here. In such a situation different profiles on the mandrel and on the impact rollers are utilized.

As will be understood from the previous description, the use of this inventive apparatus and this inventive process the economical production of profiled hollow workpieces can be achieved with a single set-up on a single mandrel. In addition, at least the same quality is maintained as had been previously obtained by use of the Grob method while using separately produced hollow blank bodies.

As a rule, in addition to the noted economic advantage, an even higher quality product standard is also achieved since the product is obtained basically by proceeding directly from raw material (here, unfinished disk 11) to the final finished product (here, workpiece 1) on the same mandrel, with the same setting and on the same machine.

While there are shown and described present preferred embodiments of the invention, it is to be distinctly understood that the invention is not limited thereto, but may be otherwise variously embodied and practiced within the scope of the following claims.

What is claimed is:

1. An apparatus for the production of a hollow workpiece, starting with a workpiece disk, having both an internal and external straight or helical profile, relative to the workpiece axis, comprising:

a mandrel having a straight or helical profile coaxial with the axis of said mandrel;

means for retaining said workpiece disk and said mandrel;

means for driving said workpiece retaining means both along the axis of said mandrel and rotatably about the axis of said mandrel;

two oppositely directed rolling head carriers, said carriers being adjustably mounted relative to the axis of said mandrel;

a rotatably driven rolling head mounted on each of said carriers;

a freely rotatable single pressure roll journalled on each of said carriers, each pressure roll having an axis parallel with or angled relative to the axis of said mandrel;

said pressure rolls being adapted, in conjunction with said workpiece retaining means, said driving means, and said mandrel, to roll form said workpiece disk into a hollow intermediate stage workpiece having a web portion and a substantially tubular rim portion connected with said web portion;

an impact roller, having an outer profile, rotatably journalled in each rolling head for planetary-type rotation therewith, defining an outermost circular periphery;

each pressure roll being located outside the outermost circular periphery of said planetary-type rotation of each impact roller; and said impact rollers and said profiled mandrel comprising means for carrying out an impact roller forming step, according to the known Grob method of impact roller forming, on both the external and internal surface of the rim portion of said intermediate stage workpiece, during every rotation of said rolling head, thereby producing said profile on said hollow workpiece in one continuous working sequence.

2. An apparatus for the production of a hollow workpiece, starting with a workpiece disk, having a partial web portion and a substantially tubular rim portion connected to said web portion, said rim portion having a straight or helical profile, relative to the workpiece axis, comprising:

a mandrel having an outer profile coaxial with the axis of said mandrel;

means for retaining said workpiece disk and said mandrel;

means for simultaneously driving said workpiece retaining means both along the axis of said mandrel and rotatably about the axis of said mandrel;

two oppositely located rolling head carriers, each carrier being adjustably mounted relative to the axis of said mandrel;

a rotatably driven rolling head mounted on each carrier;

a freely rotatable pressure roll journalled on each carrier, said pressure roll having an axis, said axis being one of parallel with and angled relative to the axis of said mandrel;

each pressure roll being adapted, in conjunction with said workpiece retaining means, said driving means, and said mandrel, to form said workpiece disk into a hollow intermediate stage workpiece having a web portion and a substantially tubular rim portion connected with said web portion, said rim portion having internal and external surfaces;

an impact roller, having an outer profile, is rotatably journalled in each rolling head for planetary-type rotation therewith, defining an outermost circular periphery;

each pressure roll being located outside the outermost circular periphery of said planetary-type rotation of each impact roller; and said impact rollers and said mandrel comprising means for carrying out an impact roller forming step, according to the known Grob method of impact roller forming, on both the internal and external surfaces of the rim portion of said intermediate stage workpiece, during every rotation of said rolling heads, thereby producing said profile on said hollow workpiece in one continuous working sequence.

3. The apparatus of claim 2, wherein both of said mandrel and said impact rollers have a straight or biased outer profile, said profile taking the form of toothings.

4. The apparatus of claim 2 wherein each impact roller profile takes the form of a toothing co-planar with or biased relative to the axis of rotation of each impact roller.

* * * * *